United States Patent [19]

Dysarz

[11] 4,334,802

[45] Jun. 15, 1982

[54] SUPPORT STRUCTURE FOR OFFSHORE PLATFORMS

[75] Inventor: Edward D. Dysarz, Houston, Tex.

[73] Assignee: James G. Brown & Associates, Inc.

[21] Appl. No.: 94,360

[22] Filed: Nov. 15, 1979

Related U.S. Application Data

[63] Continuation-in-part of Ser. No. 73,308, Sep. 7, 1979, abandoned.

[51] Int. Cl.[3] ..... E02B 17/02; E02B 17/08

[52] U.S. Cl. ..... 405/196; 405/227

[58] Field of Search ..... 405/195–200, 405/203, 224, 227; 175/8, 9

[56] References Cited

U.S. PATENT DOCUMENTS

| | | | |
|---|---|---|---|
| 2,653,451 | 9/1953 | McCullough | 405/195 |
| 3,967,457 | 7/1976 | Lovie | 405/198 |
| 4,015,434 | 4/1977 | Tarrant | 405/198 |
| 4,041,711 | 8/1977 | Lucas | 405/197 |
| 4,045,968 | 9/1977 | Gerwick | 405/195 |

*Primary Examiner*—Ernest R. Purser

*Attorney, Agent, or Firm*—Ned L. Conley; Murray Robinson; David Alan Rose

[57] ABSTRACT

A structure for use in supporting a platform above a body of water is disclosed. The structure includes a leg extending between the bed of the body of water, the seabed, and the platform. The overall cross-sectional area of the leg is greatest near the seabed and decreases moving upwardly away from the seabed.

6 Claims, 39 Drawing Figures

SUPPORT STRUCTURE FOR OFFSHORE PLATFORMS

This is a continuation-in-part of application Ser. No. 073,308, filed Sept. 7, 1979 and now abandoned.

BACKGROUND OF THE INVENTION

1. Field of the Invention

The present invention relates generally to structures for supporting offshore platforms above the surface of the water and more particularly to a structure that includes a leg having an overall cross-sectional area that is greatest adjacent the seabed and decreases moving upwardly along such leg from the seabed to a region above the seabed and is substantially constant moving from such region to the platform. While the invention has application in many types of offshore platform configurations, it is particularly useful in connection with mobile, jackup type offshore platforms.

2. Description of the Prior Art

Rigs for performing various operations at sea, often referred to as "offshore rigs," generally include a superstructure or platform supported above the surface of the water by a support structure extending between the superstructure and the seabed.

In the prior art, support structures have commonly included a plurality of legs extending either vertically or at an angle between the platform and the seabed. The legs of the prior art ordinarily have a substantially uniform cross-sectional area along their entire length. For examples of such prior art legs, see, e.g., U.S. Pat. No. 3,466,878, issued to Esquillan et al. on Sept. 16, 1969, (cylindrical or tubular legs) and U.S. Pat. No. 3,183,676, issued to LeTourneau on May 18, 1965 (lattice-type legs). The legs may engage the seabed by means of spud caissons (see, e.g., Le Tourneau, supra), or by means of piles driven into the seabed (see, e.g., Esquillan, supra), or by means of a flat surface, referred to as a "mat" interconnecting the lowermost ends of the legs and resting directly on the seabed (see, e.g., U.S. Pat. No. 3,699,688, issued to Estes on Oct. 24, 1979). The legs may be interconnected by a truss network as shown in U.S. Pat. No. 3,093,972, issued to Ward on June 18, 1963. The legs of the prior art sometimes do not have a uniform cross-sectional area along their entire length. For examples of such prior art legs, see, e.g., U.S. Pat. No. 4,045,968, issued to Gerwick, Jr. on Sept. 6, 1977. For examples of other non-uniform cross-section structures which might be placed in the water, see, e.g., U.S. Pat. No. 3,201,945, issued to Sutton on Aug. 24, 1965 and drawings of Offshore Equipment Development Co. bearing the date of July 12, 1976.

Generally speaking, the support structure, including the number, arrangement and actual configuration of the legs must be established so that the structure is capable of supporting several thousand tons of weight above the surface of the water with a high degree of overall stability as well as withstanding the often tremendous forces of winds, waves, currents and tides. As the length of the legs of the support structure increases, however, the potential of a leg of the support structure to fail due to the forces of wind, waves and/or currents increases. In order to lessen this potential for failure, there has been a tendency in the prior art to increase the structural strength of longer length legs by increasing the cross-sectional area of such legs uniformly along their entire length or to add frame-type bracing extending their entire length (see, U.S. Pat. No. 3,007,316, issued to Higgins, Jr. on Nov. 7, 1961). It is known in the prior art, however, that the force per unit length arising from wave motion acting on a submerged cylindrical pile can be approximated as:

$$f \cong \tfrac{1}{2}\rho C_D D U|U| + \rho C_M \frac{\pi D^2}{4} \frac{\partial U}{\partial t}$$

where f=force per unit length=density of the fluid $\rho$U=velocity perpendicular to the pile due to wave motion $\partial U/\partial t$=acceleration perpendicular to the pile due to wave motion D=pile diameter $C_M$=inertial coefficient $C_D$=drag coefficient In accordance with the foregoing, it can be seen that the force per unit length generated by a particular wave increases as the cross-sectional area of the pile increases. Thus, as the cross-sectional area of a leg of a support structure is increased for the purpose of withstanding the forces of waves, the effective force generated by a particular wave also increases. Similarly, additional bracing along the entire length of the leg adds to the total cross-sectional area of the leg, including the region along the leg where the velocity and acceleration of the fluid in a wave is the greatest, whereby the force generated by the wave at that region is increased. As a result, the prior art techniques of increasing the structural strength of the legs uniformly along their entire length is highly inefficient.

SUMMARY OF THE INVENTION

The present invention is a highly efficient structure for use in supporting an offshore platform above the surface of the water. The structure of the invention includes a leg whose cross-sectional area is largest in the region where the tendency to fail due to the forces of wind, current, waves and tides is the greatest and is smallest in the region where the velocity and acceleration of the water due to wave action is the greatest. In this regard, it has been found that, for support structures in deep water, the region where the leg of a support structure is most likely to fail due to the forces of wind, current, waves and tides is the greatest is the region of the leg adjacent the seabed. This is due to the fact that most of these forces act at or near the surface of the water whereby the greatest moment generated by such forces is at the seabed. Furthermore, it is known in the prior art that the velocity and acceleration of the water due to the action of a wave is greatest at the crest of the wave and decreases rapidly moving from the crest toward the seabed. As a result, for a cylindrical pile having a uniform cross-section, the force per unit length impressed against a pile by a wave decreases substantially exponentially moving from the crest of the wave to the seabed.

The support structure of the invention includes a leg whose cross-sectional area is greatest at its lowermost point and decreases moving upwardly away from such lowermost point to a region spaced above such lowermost point, such decrease resulting from a diminution of the lateral expanse of the leg substantially around the entire boundary of the leg measured from any member of the leg. The cross-sectional area of the leg is substantially constant moving from such region to the platform.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENTS

1. Introduction

The support structure of the preferred embodiment of the invention has particular utility and provides great benefits when used as part of a mobile jack-up rig to be used in deep water, such as, for example, water greater than 400 feet in depth. Such rigs, in turn, may be used for deep water drilling, crane support or workover wherein mobile buoyant or nonbuoyant openwork jack-up platforms are used in tender-assisted or in a self-contained manner. It should be realized, however, that the support structure of the invention could be used to support and/or suspend any of a variety of apparatus above a water surface in depths that may vary from a few feet to deep water.

2. General Configuration of the Structure

Figure 1:
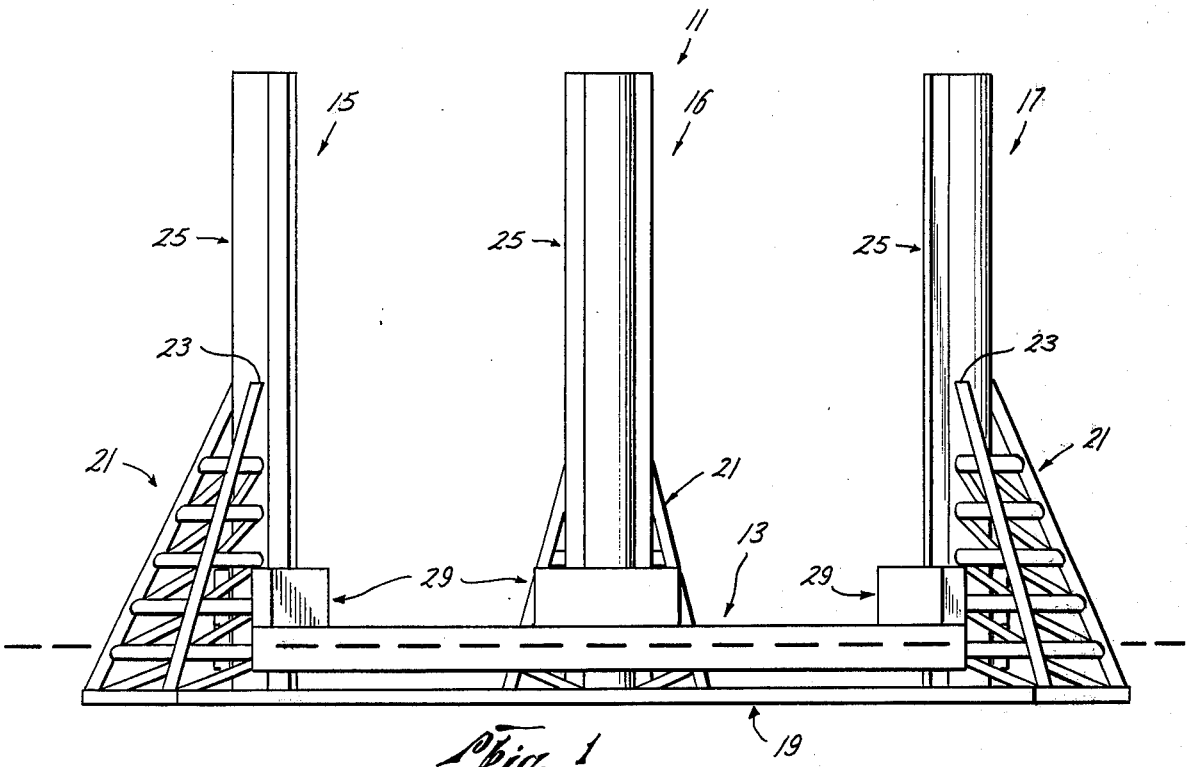
FIG. 1 is an elevation of a jack-up rig, including one embodiment of the support structure of the invention, in position to be transported to or from the operations site.

Referring to FIG. 1, mobile jack-up rig 11 is shown in its transportable position. Rig 11 includes a platform or superstructure 13 and a support structure that includes legs 15, 16, 17 and mat 19. Although the support structure is shown in elevation as including three legs, any number of legs can be used depending on the design of the platform, the nature of the use of the platform, the environmental and other physical conditions of the operations site and/or the desires of the user.

Mat 19 is substantially flat and made of a heavy material. The particular size and configuration of mat 19 may vary widely in accordance with numerous considerations including the number, orientation and configuration of the legs of the support structure.

Legs 15, 16, 17 are substantially identical, each leg having a portion 21 whose cross-section decreases from its lowermost portion to its uppermost portion, such decrease resulting from a diminution of the lateral expense of the leg substantially around the entire boundary of the leg measured from any member of the leg (herein referred to as a "variable cross-section portion"). Variable cross-section portion 21 extends from mat 19 to point 23 spaced above mat 19 and substantially constant cross-section portion 25 extending above point 23. The particular configuration of legs 15, 16, 17 may vary widely in accordance with the foregoing description. Numerous exemplary embodiments will be described infra with reference to FIGS. 3 through 37. It will be noted, however, that for all embodiments the cross-sectional area of variable cross-section portion 21 (the cross-sectional area at some point along the length of a leg is defined herein as the total area bounded by a line lying in a plane perpendicular to the axis of such leg at such point and completely surrounding all components of the leg) is greatest at the lowermost point of the leg and decreases moving upwardly away from such lowermost point toward point 23.

Figure 2:
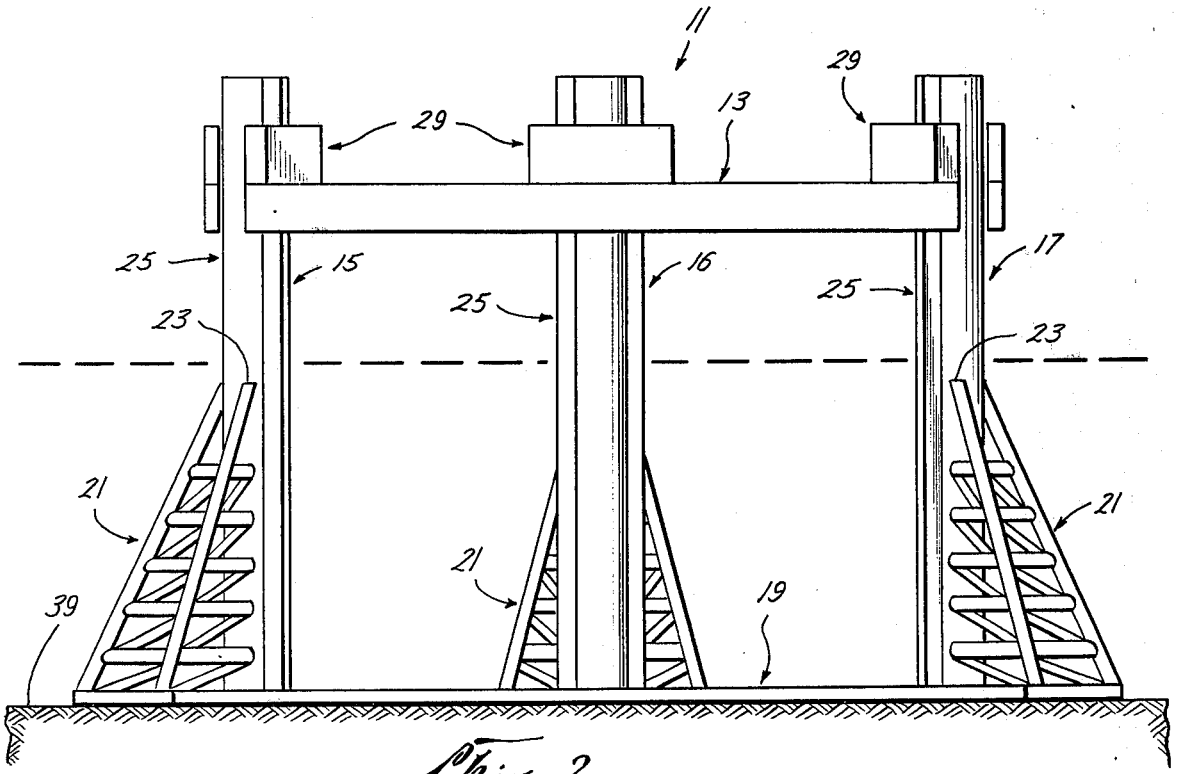
FIG. 2 is an elevation of the jack-up rig of FIG. 1 in its jacked-up position at an operations site.
Figure 2A:
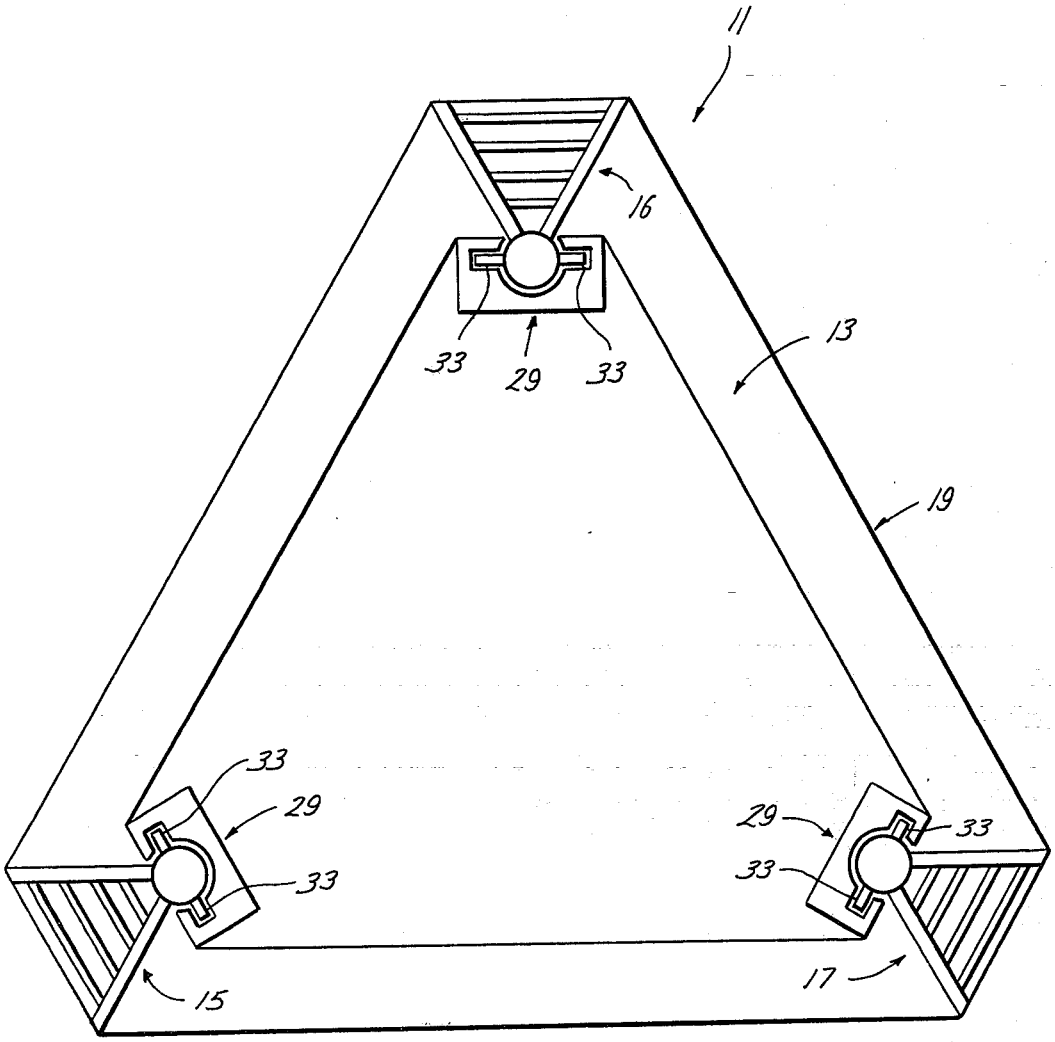
FIG. 2A is a plan view of the jack-up rig of FIG. 1.

Each of legs 15, 16, 17 is movably attached to platform 13 by a jacking means shown in FIG. 2A as a rack-and-pinion type jack that includes pinion drive apparatus and leg guide 29 secured to platform 13 and racks 33 secured along the lengths of the leg. Pinion drive apparatus may include electric motors, hydraulic motors or other prime mover. Although rack-and-pinion type jacking means is preferred, any type of jacking means, such as, for example, chain jacks and friction jacks, may be used. The jacking means should be such that mat 19 can be variably positioned between (1) a raised position wherein mat 19 is located just beneath platform 13 (see FIG. 1), and (2) a lowered position wherein mat 19 is spaced a substantial distance, for example, 400 feet, beneath platform 13 (See FIG. 2). The actual distance beneath platform 13 that mat 29 can be positioned will, of course, depend on the length of legs 15, 16, 17.

Platform 13 should be sufficiently buoyant or should be connected to appropriate floating apparatus such that rig 11 will float on the surface of the water when mat 19 is in the raised position (see FIG. 1). In this way, when mat 19 is in the raised position, rig 11 can be towed to the operations site. At the operations site, mat 19 is lowered to seabed 39 (see FIG. 2). Once mat 19 is resting on seabed 39, jacking is continued so as to raise platform 13 above the surface of the water. In this position, the desired operations of the rig can begin.

Preferably, the length of the variable cross-section portion 21 of legs 15, 16, 17 should be approximately equal to the average depth of the water so that point 23 will ordinarily be proximate the surface of the water. In this regard, it will be appreciated that a particular jack-up rig will be used at numerous operation sites and that the average depth of the water will vary from one site to another. Therefore, it is unlikely that point 23 will always be at the surface of the water.

3. Specific Embodiments of the Structure

FIGS. 3–14 show various embodiments of the support structure of the invention, the leg of all such embodiments including one or more leg cords which may be vertical or inclined. FIGS. 15–37 show various configurations of the leg cords that can be used in the embodiments of FIGS. 3–14. Because the particular attachment of a rack or other jacking means component to a leg will depend largely on the configuration of the leg cord or cords, such rack or other jacking means will be described only with reference to FIGS. 15–37, although it will be understood that where the support structure is used as part of a jack-up rig, the legs of the support structure will have some type of jacking means connected thereto or incorporated therewith.

Figure 3:
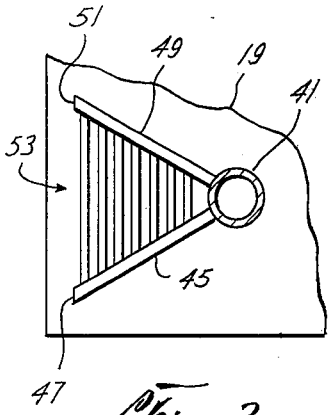
FIGS. 3 and 4 are a plan view and a partial elevation, respectively, of a leg of one embodiment of the support structure of the invention.
Figure 4:
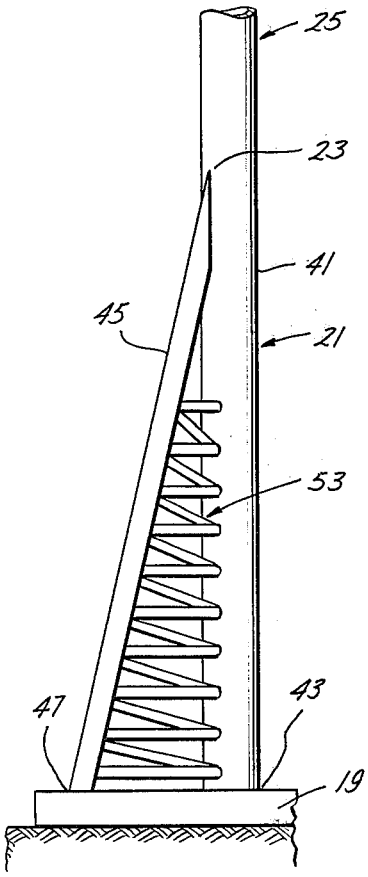

Referring to the embodiment of FIGS. 3 and 4, variable cross-section portion 21 includes (1) constant cross-section leg cord 41 secured to mat 19 at point 43 and extending substantially vertically therefrom; (2) constant cross-section leg cord 45 secured to mat 19 at point 47 spaced away from point 43, extending upwardly from mat 19 and toward cord 41 and secured to cord 41 proximate point 23, i.e., the uppermost point of portion 21; (3) constant cross-section leg cord 49 secured to mat 19 at point 51 spaced from both points 43 and 47 and extending upwardly from mat 19 and toward cord 41 and secured to cord 41 proximate point 23; and (4) reinforcement truss network 53 extending among cords 41, 45, 49. In accordance with the foregoing, it can be seen that portion 21 of the embodiment of FIGS. 3 and 4 has a generally pyramidical configuration with point 23 at the peak of the pyramid and points 43, 47, 51 at the base of the pyramid. Constant cross-section portion 25 of the embodiment of FIGS. 3 and 4 includes an extension of cord 41, referencd in FIG. 4 as 41A.

Figure 5:
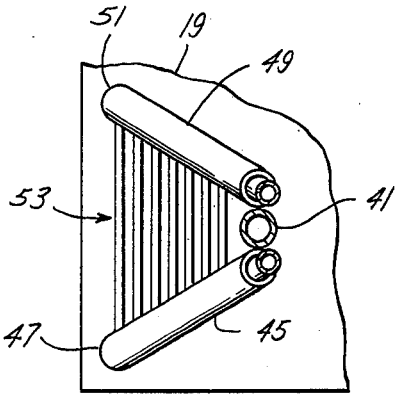
FIGS. 5 and 6 are a plan view and a partial elevation, respectively, of a leg of an alternative embodiment of the support structure of the invention.
Figure 6:
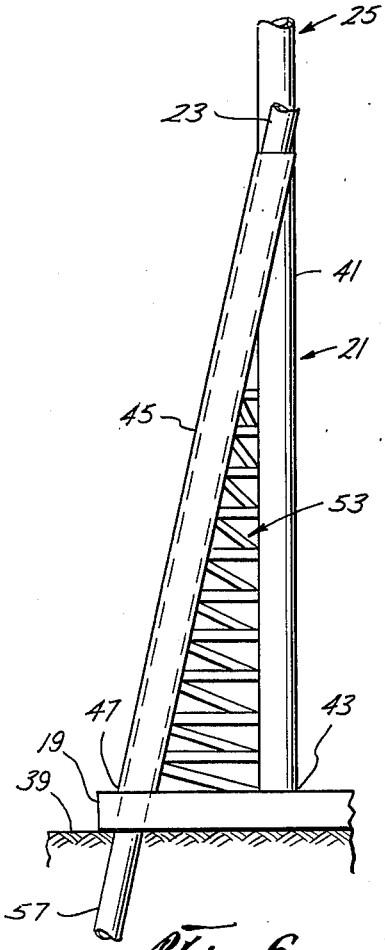

The embodiment of FIGS. 5 and 6 is similar to that of FIGS. 3 and 4 except that the leg further includes piles, such as that shown at 57 driven through leg cords 45, 49 and mat 19 into seabed 39. Leg cords 45, 49 of the embodiment of FIGS. 5 and 6 will ordinarily have a tubular configuration (see, e.g., the configurations of FIGS. 15–17 described infra) so that piles can be driven therethrough. Using such piles, rig 11 can be used as a battered leg fixed platform similar to fixed platforms already in use. Unlike a fixed platform, a rig 11 using the leg of FIGS. 7 and 8 can be recovered and reused.

Figure 7:
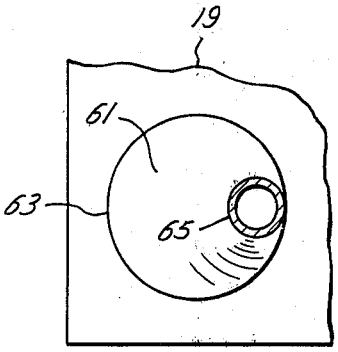
FIGS. 7 and 8 are a plan view and a partial elevation, respectively, of a leg of an alternative embodiment of the support structure of the invention.
Figure 8:
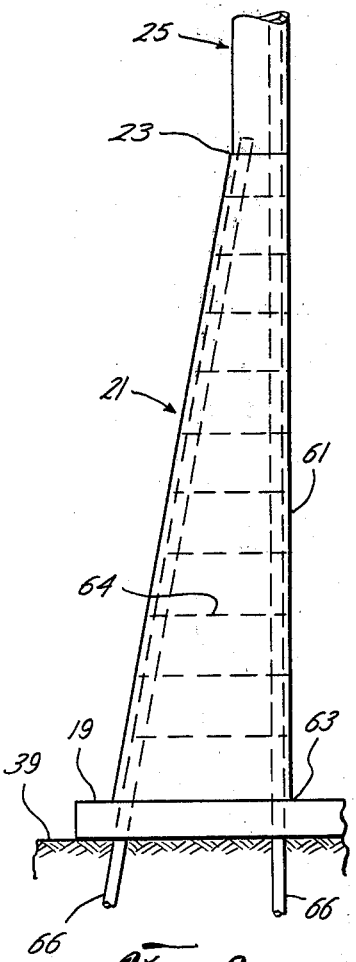

Referring to the embodiment of FIGS. 7 and 8, variable cross-section portion 21 includes truncated cone 61 having base 63 secured to platform 19. Preferably, one side of cone 61 is substantially vertical. Cone 61 may be made of steel plate reinforced by internal stiffening members (shown in FIG. 8 as dashed lines 64). Cone 61 has a substantially circular opening at point 23. Constant cross-section portion 25 includes tubular member 65 having a diameter substantially equal to that of the circular opening of cone 61 at point 23. Member 65 is secured to cone 61 at point 23 and extends substantially vertically therefrom. It will be appreciated that the embodiment of FIGS. 7 and 8 includes only a single leg cord whose cross-section varies below point 23 and is constant above point 23. The embodiment of FIGS. 7 and 8 may further include piles 66 driven through member 65, cone 61 and mat 19 into seabed 39.

The embodiments of FIGS. 9 through 14 differ from those described with reference to FIGS. 1 through 8 in that the support structure in which such embodiments are used includes a spud can 101 at the base of each leg rather than a mat 19. Spud cans, also called spud caissons, are well known in the art of offshore rigs and any configuration of spud can or caisson can be used in such embodiments.

Figure 9:
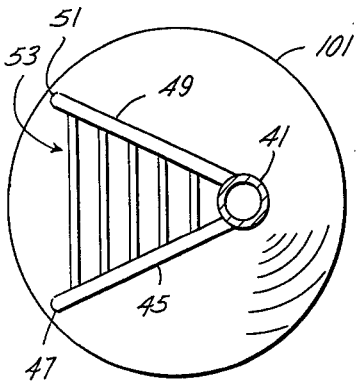
FIGS. 9 and 10 are a plan view and a partial elevation, respectively, of a leg of an alternative embodiment of the support structure of the invention.
Figure 11:
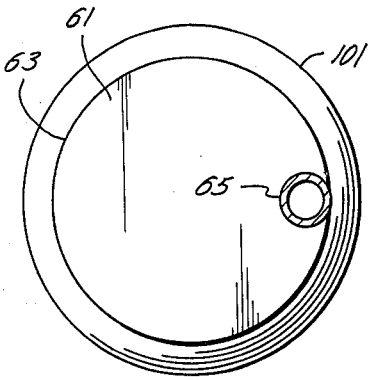
FIGS. 11 and 12 are a plan view and a partial elevation, respectively, of a leg of an alternative embodiment of the support structure of the invention.
Figure 10:
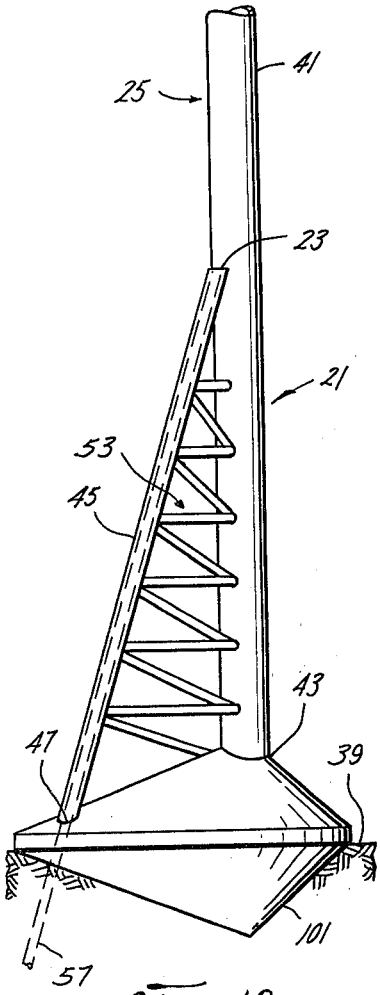
Figure 12:
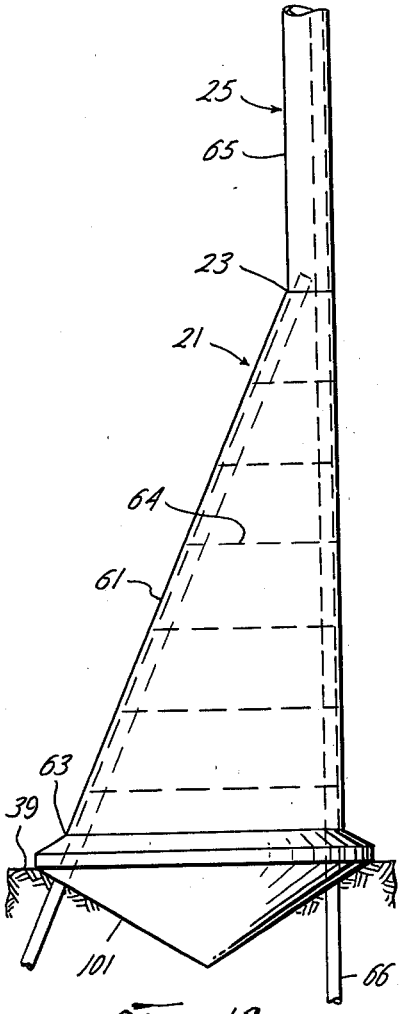

Thus, the embodiment of FIGS. 9 and 10 is similar to that of FIGS. 5 and 6 except that spud can 101 is substituted for mat 19. The like parts of the embodiment of FIGS. 9 and 10 and the embodiment of FIGS. 5 and 6 are given the same reference numbers. Similarly, the embodiment of FIGS. 11 and 12 is similar to that of FIGS. 7 and 8 except that spud can 101 is substituted for mat 19. The like parts of the embodiment of FIGS. 7 and 8 and the embodiment of FIGS. 11 and 12 are given the same reference numbers.

Figure 13:
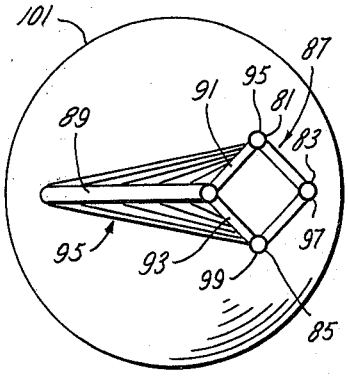
FIGS. 13 and 14 are a plan view and a partial elevation, respectively, of a leg of an alternative embodiment of the support structure of the invention.
Figure 14:
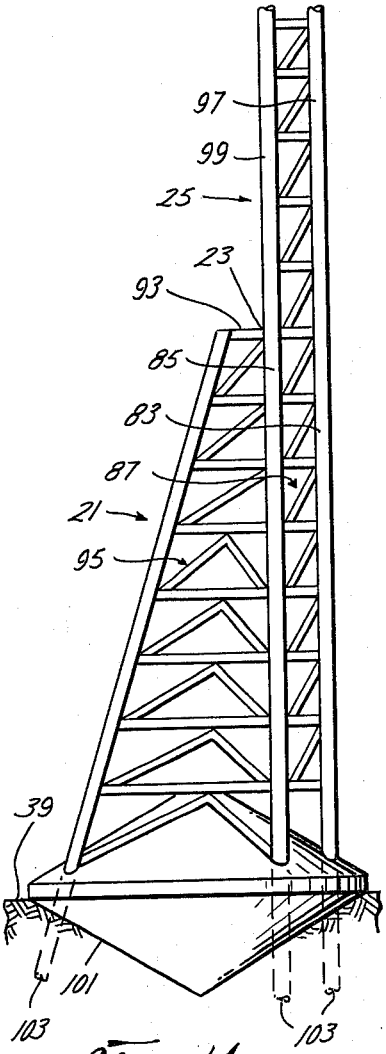

Referring to the embodiment of FIGS. 13 and 14, variable cross-section portion 21 includes (1) parallel leg cords 81, 83, 85 secured to spud can 101 and extending substantially vertically therefrom, leg cords 81, 83, 85 being arranged in a generally triangular pattern and connected together by truss network 87; (2) leg cord 89 secured to spud can 101 at a point spaced away from cords 81, 83, 85 and extending from spud can 101 upwardly and generally toward cords 81, 83, 85 in a plane common to cord 83 and secured to cords 81, 85 proximate point 23 by truss members 91, 93, respectively; and (3) truss network 95 extending among cords 81, 85 and 89. Constant cross-section portion 25 includes extensions of cords 81, 83, 85, shown as cords 95, 97, 99, connected together by truss network 101. If the leg cords of the embodiment of FIGS. 13 and 14 have a tubular configuration, such embodiment may further include piles, shown as dashed lines 103, extending through such cords and spud can 101 into seabed 39.

As indicated supra, FIGS. 15–36 show various configurations of leg cords that can be used in the embodiments of the support structure of the invention shown in FIGS. 3–14. A cross-sectional view of each such configuration is shown together with a portion of a truss network (indicated by reference number 111) which may be attached thereto (such as for leg cords 41, 43, 47 of FIGS. 3–6, 9 and 10, and leg cords 81, 83, 85 and 89 of FIGS. 13 and 14). It will be noted, however, that for some embodiments, such as the single cord embodiment of FIGS. 7, 8, 11 and 12, no truss network will be included. Also, in showing and describing such configurations, reference will be made to jacking means or a component thereof. It will be understood however, that not all leg cords will include or otherwise be part of jacking means. For example, leg cords 43 and 47 of FIGS. 3–6, 9 and 10 and leg cord 89 of FIGS. 13 and 14 ordinarily will not include or otherwise be part of jacking means. Furthermore, where one of the leg cord configurations of FIGS. 15–36 is used as the leg cord of the embodiment of FIGS. 7, 8, 11 and 12, it will be understood that the dimensions of such cord over portion 21 will increase moving from point 23 to either mat 19 or spud can 101 as the case may be. As a final preliminary note to the description of the configurations of FIGS. 15–37, it will be understood that, excepting the configuration of FIG. 16, all of such configurations have been used in leg cords of the prior art.

Each of the configurations of FIGS. 15–28 includes a principal member 121 with one or more racks of a rack-and-pinion jacking means attached thereto. Such racks are identified generically by reference number 133. Depending on the embodiment, rack 133 may have a single pinion-engaging edge (such a rack is specially identified as rack 133A with the pinion-engaging edge identified as edge 201 and the opposite edge identified as edge 203) or may have two pinion-engaging edges (such a rack is specially identified as rack 133B with the pinion-engaging edges identified as edges 205).

Figure 15:
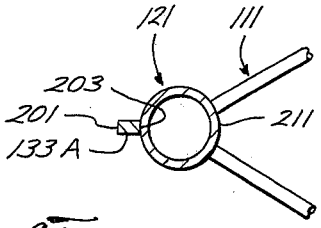
FIGS. 15–28 are cross-sectional views of various alternative configurations of the leg cords of the legs shown in FIGS. 3–14 showing how a rack and truss work, if any, can be attached thereto.
Figure 16:
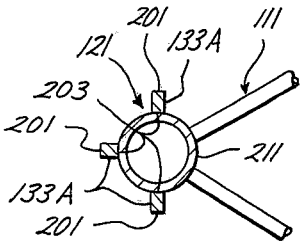
Figure 17:
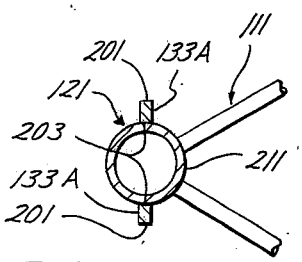

In accordance with the foregoing, FIG. 15 shows member 121 as including cylindrical tubular beam 211. A rack 133A is secured to the outside surface of beam 211 with edge 201 facing radially away from beam 211. Rack 133A of the FIG. 15 embodiment extends axially along beam 211. Beams of truss network 111 are connected to the outer surface of beam 211 and extend generally away from rack 133A. FIG. 16 shows a leg cord configuration similar to that of FIG. 15 except that two additional racks 133A are secured to beam 211, such additional racks being azimuthally spaced to either side of the first rack 133A by, for example, 90 degrees. FIG. 17 shows a leg cord configuration similar to that of FIG. 16 with only the additional racks 133A shown as diametrically opposed to one another. The first rack 133A shown in the FIG. 16 configuration is deleted.

Figure 19:
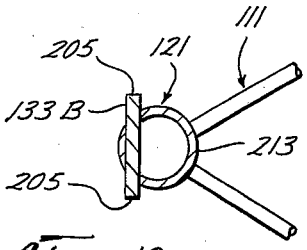
Figure 20:
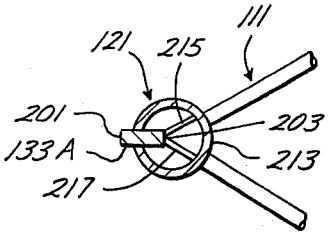
Figure 18:
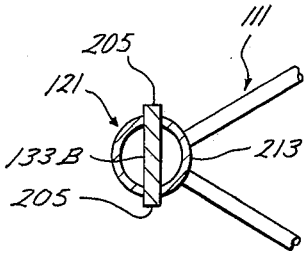

FIGS. 18–20 show principal member 121 as including cylindrical tube 213. The FIG. 18 configuration includes a rack 133B extending across a diameter of tube 213 with beams of truss network 111, attached to and extending from tube 213 on one side of rack 133B. Edges 205 of rack 133B both are disposed outside of and face away from the outer surface of tube 213. The FIG. 19 leg cord configuration is similar to that of FIG. 18 except that rack 133B of FIG. 19 extends through a non-diametrical chord of tube 213 and is spaced farther from the beams of truss network 111 than is rack 133B of FIG. 18. The FIG. 20 configuration includes a rack 133A extending radially through the wall of tube 213 such that edge 201 of rack 133A faces outwardly from the outer surface of tube 213 and edge 203 of rack 133A is inside tube 213 and faces toward the center of tube 213. Member 121 of the FIG. 20 configuration further includes reinforcement plates 215, 217 extending between edge 203 of rack 133A and the inner surface of tube 213.

Figure 21:
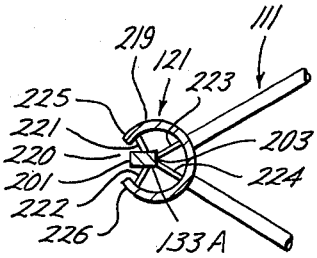
Figure 22:
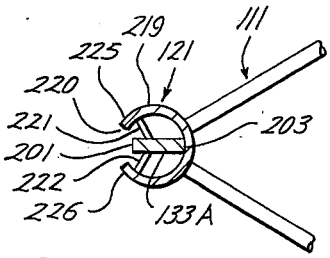

FIGS. 21 and 22 show principal member 121 as including tube 219 having notch 221 of V-shaped cross section extending along the entire length of tube 219. The configuration of FIG. 21 includes a rack 133A extending radially through tube 219 at the innermost point of notch 221. Edge 201 of rack 133A is recessed inside of notch 221 so that no part of rack 133A extends beyond the outer surface of tube 219. Edge 203 of rack 133A is inside tube 219 proximate the center of tube 219. Member 121 of the FIG. 21 configuration further includes plates 223, 225 extending from edge 203 of rack 133A to the inner surface of tube 219. The beams of truss network 111 extend from tube 219 generally away from notch 221. The FIG. 22 leg cord configuration is similar to that of FIG. 21 except that plates 223, 225 are deleted and rack 133A extends completely through tube 219 and is attached at edge 203 to the inner surface of tube 219.

Figure 23:
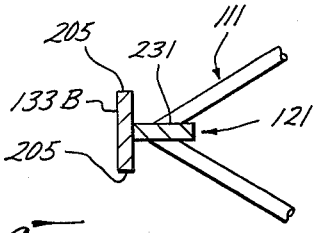
Figure 25:
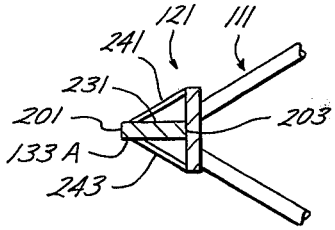
Figure 26:
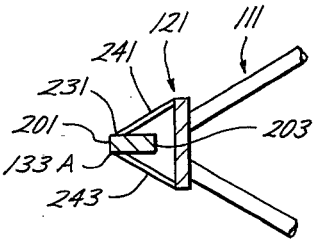

In the leg cord configurations of FIGS. 23 and 26, principal member 121 includes flat steel beam 231 of rectangular cross section. In the FIG. 23 configuration, beam 231 perpendicularly abuts a rack 133B at the center of such rack 133B such that edges 205 face away from either side of beam 231. The beams of network 111 are connected to opposite sides of beam 231 and extend generally away from rack 133B. In the FIG. 24 configuration, a rack 133A perpendicularly abuts beam 231 at the center of one side of beam 231 such that edge 201 of such rack 133A faces away from beam 231. The beams of network 111 are both connected to and extend away from the other side of beam 231. The configuration of FIG. 25 is similar to that of FIG. 24 except that member 121 of the configuration of FIG. 25 further includes reinforcement plates 241, 243 extending between either side of the rack 133A and the ends of beam 231. The configuration of FIG. 26 is similar to that of FIG. 25 except that the rack 133A of FIG. 26 does not directly abut beam 231. Instead, edge 201 of rack 133A is spaced from beam 231. Rack 133A of FIG. 26 is connected to beam 231 by means of plates 241, 243.

Figure 27:
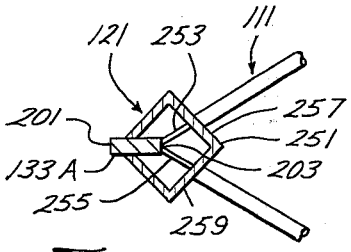
Figure 24:
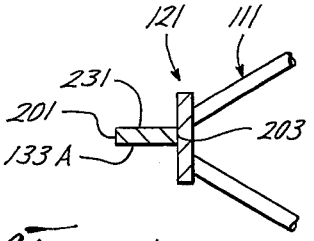
Figure 28:
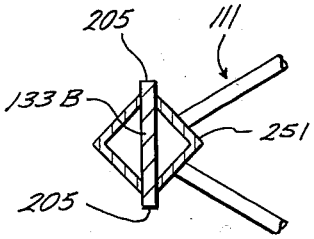

In the leg cord configurations of FIGS. 27 and 28, principal member 121 includes tube 251 having a substantially square cross section. In the FIG. 27 configuration, a rack 133A extends through a corner of tube 251 with edge 201 exposed outside of tube 251 and facing away from tube 251 generally in the direction of an extension of a diagonal of tube 251. Edge 203 of rack 133A faces toward the center of tube 251. Member 121 of the FIG. 27 configuration further includes steel reinforcement plates 253, 255 extending between the edge 203 of rack 133A and the sides of tube 251 opposite the corner of tube 251 through which the rack 133A extends, such sides being identified as sides 257, 259, respectively. Beams of truss network 111 are connected to and extend from sides 257, 259, respectively. In the FIG. 28 configuration a rack 133B extends completely through a diagonal of tube 251 such that edges 205 of such rack 133B both are disposed outside of tube 251. Beams of truss network 111 extend from the sides of tube 251 to one side of the rack 133B.

Figure 29:
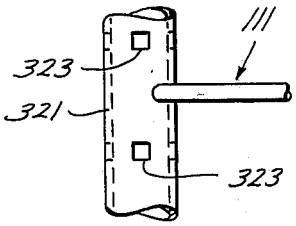
FIGS. 29 and 30 are a partial elevation and a partial cross-sectional view, respectively, of an alternative configuration of the leg cords of the legs shown in FIGS. 3–14.
Figure 30:
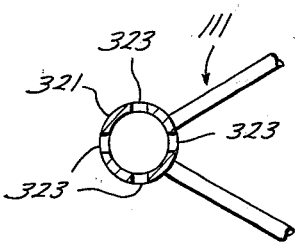
Figure 31:
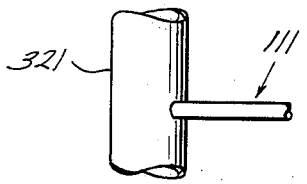
FIGS. 31 and 32 are a partial elevation and a partial cross-sectional view, respectively, of an alternative configuration of the leg cords of the legs shown in FIGS. 3–14.
Figure 35:
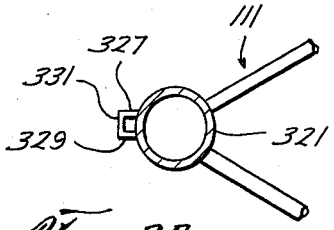
FIGS. 33–35 are partial elevations, from two angles, and a partial cross-sectional view, respectively, of an alternative configuration of the leg cords of the legs shown in FIGS. 3–14.
Figure 32:
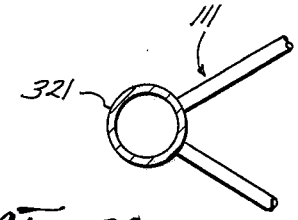
Figure 36:
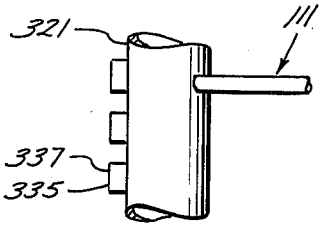
FIGS. 36–38 are partial elevations, from two angles, and a partial cross-sectional view, respectively, of an alternative configuration of the leg cords of the legs shown in FIGS. 3–14.
Figure 33:
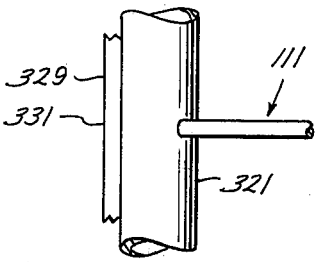
Figure 37:
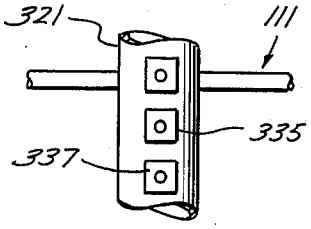
Figure 34:
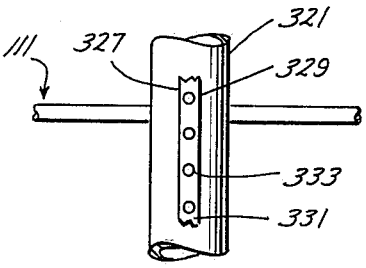
Figure 38:
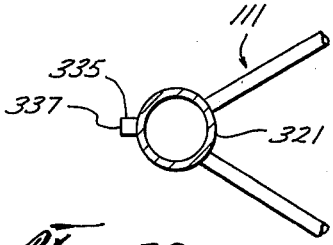

Each of the configurations of FIGS. 29–36 includes cylindrical tubular principal member 321 with beams of truss network 111 secured to and extending from the outer surface of member 321. The configurations differ only with respect to the jacking means related thereto. Thus, the configuration of FIGS. 29 and 30 is to be used with a pin-type jack and includes a plurality of holes 323 extending through the wall of member 321. Such holes may be arranged in a plurality of axial lines spaced azimuthally about member 321 as shown in FIGS. 29 and 30. In the configuration of FIGS. 31 and 32, member 321 has a smooth surface to be used with a friction-type jack such as those manufactured by DeLong or Varco. In the embodiment of FIGS. 33–35, parallel steel plates 327, 329 are attached to and extend from the outer surface of member 321 along the length of member 321. Steel plate 331 is attached between the outer edges of plates 327, 329 so as to form a flat surface spaced away from member 321 and extending generally axially along member 321. Steel plate 331 has holes 333 extending therethrough so as to provide a rack-type means for a pin-type jack. Alternatively, as shown in the configuration of FIGS. 36–38, a series of steel boxes 335, each having an outer plate 337 with a hole therethrough can be secured in an axially-extending line to the outer surface of member 321.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A rig for use in supporting and using equipment above the ocean bottom, comprising:

a body;

leg means connected to said body for supporting said body above such ocean bottom;

said leg means including elevation means for elevating said body above such ocean bottom and connection means for connecting said elevation means to said body and at least three legs, each of said legs having a first end and a second end, said first end having means for landing the bottom of said first end on such ocean bottom, a first portion of variable cross-sectional area extending from said first end to a point intermediate said first end and said second end and a second portion of substantially constant cross-sectional area extending from said intermediate point to said second end, the cross sectional area of said first portion being greatest at said first end and decreasing moving from said first end to said intermediate point, the cross-sectional area of said second portion being no greater than the cross-sectional area of said first portion at said intermediate point.

2. The rig of claim 1 wherein said first portion is shaped to permit said elevation means to raise said legs to a position wherein said first end is substantially adjacent to said body.

3. The rig of claim 1 or 2 wherein said leg includes at least one leg cord.

4. The rig of claim 3 wherein said leg chord includes a tube and said tube has a hollow center extending the entire length of said tube and wherein there is further included a pile, said pile extending through said hollow center and beyond said first end.

5. A rig for use in supporting and using equipment above the ocean bottom comprising:

a body;

leg means connected to said body for supporting said body above such ocean bottom;

said leg means including elevation means for elevating and lowering said leg means above such ocean bottom relative to said body and for connecting said elevation means to said body and at least three legs, each of said legs having a first end and a second end, said first end having means for landing the bottom of said first end on such ocean bottom, a first portion of variable cross-sectional area extending from said first end to a point intermediate said first end and said second end and a second portion of substantially constant cross-sectional area extending from said intermediate point to said second end, the cross-sectional area of said first portion being greatest at said first end and decreasing moving from said first end to said intermediate point, the cross-sectional area of said second portion being no greater than the cross-sectional area of said first portion at said intermediate point.

6. The rig of claim 5 wherein said elevation means elevates and lowers said leg means in a substantially vertical direction.

* * * * *

UNITED STATES PATENT AND TRADEMARK OFFICE

CERTIFICATE OF CORRECTION

PATENT NO. : 4,334,802

DATED : June 15, 1982

INVENTOR(S) : Edward D. Dysarz

It is certified that error appears in the above—identified patent and that said Letters Patent is hereby corrected as shown below:

Column 10; line 3, change "chord" to --cord--.

Signed and Sealed this

*Seventh* Day of *September 1982*

[SEAL]

*Attest:*

GERALD J. MOSSINGHOFF

*Attesting Officer*

*Commissioner of Patents and Trademarks*